United States Patent [19]

Cuthbert

[11] 3,994,734

[45] Nov. 30, 1976

[54] HIGH DENSITY INFILTRATING PASTE

[75] Inventor: Stanley G. Cuthbert, Salix, Pa.

[73] Assignee: SCM Corporation, New York, N.Y.

[22] Filed: Apr. 22, 1974

[21] Appl. No.: 462,813

[52] U.S. Cl. ..... 106/1; 29/182.2; 29/182.5; 75/.5 A; 75/.5 R; 106/38.22; 106/38.27; 106/286

[51] Int. Cl.[2] ..... B22F 1/00; C23C 3/00

[58] Field of Search ..... 106/1, 286, 38.22, 38.9, 106/38.27, 38.28; 117/131; 148/24; 75/.5 A, .5 R; 29/182.2, 182.5

[56] References Cited

UNITED STATES PATENTS

| | | | |
|---|---|---|---|
| 2,401,221 | 5/1946 | Bourne | 29/182.2 X |
| 2,844,456 | 7/1958 | Llewelyn | 75/.5 AA |
| 2,956,304 | 10/1960 | Batten et al. | 425/1 |
| 3,073,270 | 1/1963 | Johnson et al. | 148/24 |
| 3,307,924 | 3/1967 | Michael | 29/182.5 |
| 3,619,170 | 11/1971 | Fisher et al. | 75/.5 |
| 3,652,261 | 3/1972 | Taubenblat | 75/.5 R |

OTHER PUBLICATIONS

Kirk-Orthmer, Encyclopedia of Chemical Technology, 2nd Revised Edition, vol. 6, TP E68.c (pp. 199, 246–248, relied on).

*Primary Examiner*—Joan E. Welcome
*Attorney, Agent, or Firm*—Thomas M. Schmitz

[57] ABSTRACT

A high density infiltrating paste for infiltrating porous iron compacts comprises powder metal dispersed in minor amounts of vehicle. The powder metal is a blend of copper powder and between about 1.8 to 3.4% iron by weight. The powder metal blend is suspended in a hydrocarbon vehicle to provide a high density infiltrating paste containing about 95% powder metal.

1 Claim, No Drawings

HIGH DENSITY INFILTRATING PASTE

BACKGROUND OF THE INVENTION

This invention pertains to a copper infiltrating paste for infiltrating a porous mass of ferruginous material and particularly to a residue-free high density infiltrating paste.

The strength of iron powder compacts can be increased by infiltrating the compacted powder iron matrix with a metal having a melting point lower than that of iron. The lower melting infiltrant is placed on the surface of the iron compact in the amount sufficient to fill the voids in the compacted iron matrix upon heating to a temperature sufficient to melt the infiltrant. The resulting mass is often heated to a temperature sufficient to sinter the iron as well as melting the infiltrant and such a process is known in the art as "sintration" or sintrating. The resulting infiltrated compact has a final strength greater than that of a non-infiltrated iron powder compact. Infiltrating processes for iron base compacts ordinarily provide copper infiltrating powder, iron or other metal to reduce erosion of the iron compact, and a refractory parting compound to facilitate removal of residue remaining after infiltration. The infiltrating composition is usually preformed into a slug which is then placed on the iron compact for filtrating.

Various infiltrating compositions suggested in the past, however, very often leave a residue which adheres to the infiltrated compact. The residue often sticks to the infiltrated part and must be chipped or ground off after the infiltration is completed. Erosion of the infiltrate compact is a further problem due to iron from the compacted iron matrix being dissolved by copper. Prealloyed copper with iron has been suggested, but these infiltrating materials leave a residue or otherwise causing sticking and roughness. Hardening compounds or refractories such as magnesium oxide or titanium oxide are incorporated into the infiltrating composition for the purpose of releasing a residue left behind from the infiltrating composition. For example, U.S. Pat. No. 3,307,924 suggests an infiltrate composition preformed into a slug that leaves a residue which shrinks and warps into a husk-like residue which may be easily removed from the infiltrated part; whereas, U.S. Pat. No. 3,619,170 suggests the inclusion of minor amounts of iron-chromium alloy within the infiltrating composition which substantially reduces the tendency of such residues to adhere and/or erode the infiltrated metal compact whereby the remaining residue can be removed by a gravitational force. Accordingly, prior art processes for infiltrating iron compacts provide refractory materials in the infiltrating paste for the purpose of facilitating removal of residues remaining from the spent infiltrating pastes after infiltration.

It now has been found that a residue-free, high density, copper infiltrating paste of flowable consistency can be applied to a compacted iron matrix and virtually elimintes the residue remaining after sintrating or infiltrating the compacted metal powder.

Accordingly, the primary object of this invention is to provide a high density, residue-free infiltrating paste comprising a powder metal blend of powder copper and minor amounts of powder iron suspended in a vehicle to form an infiltrating paste of flowable consistency that can be expediently applied to the iron compact from a dispenser.

A further object is to provide a residue-free infiltrating paste free of refractory parting compounds.

A further object is to provide an infiltrating paste for imparting good strength to iron powder compacts with negligible erosion to the iron compact.

A still further object is to flowable infiltrating paste that can be dispensed automatically from a dispenser and applied directly as received from the dispenser to an iron compact without the intermediate step of preparing infiltrating slugs.

A further object is to provide an infiltrating material for imparting good strength to iron powder compacts without eroding the base metal.

These and other advantages of this invention will become more apparent by referring to the Detailed Description of the Invention.

SUMMARY OF THE INVENTION

A high density, residue-free infiltrating paste for strengthening and/or sealing porous ferruginous metal materials is disclosed. The high density infiltrating paste includes about 95 weight parts of a powder metal blend containing powdered copper and powder iron wherein the powder metal blend contains between about 1.8 to 3.4% by weight powder iron. The infiltrating paste contains up to about 5 parts hydrocarbon vehicle.

DETAILED DESCRIPTION OF THE INVENTION

The high density infiltrate paste of this invention includes a metal powder blend of copper and minor amounts of iron wherein the metal powder blend is suitably dispersed in a fugitive hydrocarbon vehicle to form an infiltrating paste.

The copper powder metal is elemental copper powder having an average preferred particle size up to about 44 microns and advantageously up to about 20 microns. Preferably, the copper powder is atomized copper and is substantially spherical and produced by atomization. Atomization of copper, for example is disclosed in U.S. Pat. No. 2,956,304 wherein water is utilized as an atomizing medium although inert liquid hydrocarbons or gas atomization processes may be utilized, and such disclosure is incorporated herein by reference.

The copper powder is blended with iron particles to produce a metal powder blend containing from about 1.8 percent to 3.4 percent weight iron. The iron powder is iron particles having an average particle size up to about 10 microns and preferably less than about 5 microns. Preferably, the iron powder is carbonyl iron powder having an average particle size up to about 5 microns. Iron particles beyond about 10 microns present compounding problems such as providing copper solution of iron and providing a suspension of metal powder in the vehicle becomes difficult in addition that undesirable liquidation occurs during the infiltrating process causing a rough surface on the base material. The carbonyl process iron particles effectively satisfy the dissolving power of copper for iron during infiltration so that even the initial copper entering the iron compact will not erode the infiltration surface of the iron compact. Erosion occurs when molten copper dissolves iron from the iron compact. Similarly, liquidation is prevented wherein rough surfaces of the infiltrated material is avoided which often occurs due to iron particles being left on the surface after the infiltrating process.

The copper-iron powder blend can be physically blended together within a ball mill or other suitable blender or mixing vessel whereby the copper powder is intimately intermixed with the iron powder. The copper-iron blend contains from about 1.8 to 3.4 weight percent of iron or, stated alternatively, 100 weight parts of powder metal blend contains from 98.2 to 96.6 weight parts of powder copper blended with 1.8 to 3.4 weight parts of iron powder. Above about 3.4% iron rough surface resulted on the infiltrated compact due to excess iron, whereas less than about 1.8% iron caused excessive erosion to the infiltrated iron compact. The copper-iron powder mixture can be premixed in a physical dry powder mixture or alternatively charged to a mixing vessel containing vehicle wherein the copper and iron powders are thoroughly mixed with the vehicle to form a uniform infiltrating paste.

The vehicle suitable for use to mix with the copper-iron blend to produce an infiltrating paste desirably is a volatile vehicle capable of volatilizing quickly, and yet resists drying of the paste mixture when exposed to air. The vehicle should include an "oily" characteristic. Suitable vehicles include, for example, an emulsified hydrocarbon containing minor amounts of hydroxy cellulose such as disclosed in U.S. Pat. No. 3,073,270; polybutadiene heat-dipolymerizable polymers such as disclosed in U.S. Pat. No. 2,908,072; and methyl cellulose, and sodium-methyl cellulose. Preferably, a castor oil derivative such as Thixin is particularly suitable vehicle for suspending the copper-iron blend to produce a suitable infiltrating paste. A small amount of surface active agent such as potassium nitrate is desirable to add to the infiltrating paste which promotes rapid alloying of the powder copper-iron blend during infiltration.

In practice, the infiltrating paste of this invention can be contacted with the porous ferruginous workpiece and thereafter heated to sufficiently raise the temperature of the infiltrating paste to cause the copper from the infiltrating paste to infiltrate the porous iron compact and fill the voids in the iron compact with copper. Infiltration can be carried out at temperatures slightly above the melting point of copper, that is above about 1,980° F, and preferably between about 2,000° F to 2,350° F. Below 2,000° F presents the possibility that molten copper may re-solidify, whereas temperatures greater than 2,350° F may cause molten copper to rapidly increase in dissolving power for iron. The tendency of molten copper to dissolve iron will cause excessive erosion of the powder iron compact. A one-step infiltration and sintering process, for example, can be achieved in about 15 minutes at 2,050° C. Desirably, infiltration takes place in an inocuous atmosphere such as an inert gas or reducing atmosphere. Reducing atmospheres, for example, include hydrogen, cracked ammonia and endothermic, whereas suitable inert gases are nitrogen, argon, and the like. The inert gases or reducing gas prevent deleterious metallic oxidation and enhance removal of adsorbed gaseous films.

A major advantage of this invention is that the flowable infiltrating paste can be applied by using a paste dispenser adapted to extrude or dispense paste material under applied pressure. Hence, the paste can be applied directly to compacted iron without first preparing individual slugs. The infiltrating paste is residue-free whereby residue no longer has to be chipped or ground off after completion of the infiltrating process. The paste consistency is advantageously adaptable to automation wherein paste can be automatically dispensed from a gun and applied as needed. The infiltrating paste advantageously is a high density paste wherein at least about 95% by weight of the paste is powder metal blend. The metal powder-binder ratio of the paste permits high density loading with minimal fugitive binder demand to provide an infiltrating paste having good compactability and high green strength. High density loading is achieved by providing fine spherical copper powder having an average particle size of less than about 44 microns and relatively smaller iron particles of less than about 5 microns. The atomized spherical copper particles efficiently pack in a highly dense manner wherein minimal particle surface area of the copper particles require not more than about 5% fugitive binder to effectively bind the metal particles. The substantially uniform spherical particles are distinguished from copper powder produced by a process such as reduction which produces a non-uniform irregular shaped particle which is not suitable for high density, residue-free infiltrating pastes.

The infiltrating material of this invention can be utilized for simultaneous infiltration and sintering at temperatures of about 2,000° to 2,100° F in an endothermic atmosphere at a dew point between about 0° and 65° F.

The following examples illustrate preferred modes of this invention but should not be construed as limiting. All parts and percentages recited in the examples are by weight and all temperatures are in degrees Fahrenheit unless otherwise specifically stated.

EXAMPLE 1

The following raw materials were mixed together in the manner hereinafter indicated.

| | |
|---|---|
| Kerosene | 5.4 lbs. |
| Kerosene-rubber solution | 31.6 lbs. |
| Castor oil derivative (Thixin) | 3.0 lbs. |
| Diethyl carbitol | 10.0 lbs. |
| Potassium nitrate | 3.0 lbs. |
| Copper (MD-154)* | 926.0 lbs. |
| Iron** | 21.0 lbs. |

*Water atomized copper being substantially spherical and having an average particle size of 44 microns.
**Carbonyl iron powder having 0.8% carbon, density of 2.68 gm./cc., and an average particle size of 5 microns.

Diethyl carbitol, Thixin, and kerosene were charged to a 100 gallon mixer in the first step and mixed until the Thixin dissolved into the mixer. Thereafter the kerosene rubber solution (60% kerosene + 30% rubber) was added to the mixture and thoroughly mixed until a uniform mixture resulted. Then the copper-iron powder mixture and potassium nitrate was added to the mixer and thoroughly mixed with the diethyl carbitol, Thixin, and kerosene until a uniform mixture resulted. The resulting composition was uniform infiltrating paste that easily passed through a 40 mesh screen.

An iron preform was fabricated by compacting a mixture of 99 weight parts, −100 mesh iron, 1 part graphite, and 1 part zinc stearate into a size suited to measure strength properties. This transverse rupture bar had a green density of 5.8 g/cc and weighed 15 grams. 4.5 grams of paste was placed on top of the slug. The whole assembly was sintered at 2,050° F with 20 minutes at temperature in endothermic atmosphere. The infiltrated bar emerged from the furnace with a clean smooth surface substantially free of erosion. The bar had a sintered density of 7.30 g/cc and a transverse rupture strength of 169,000 psi.

EXAMPLE 2

4.5 grams of paste from Example 1 were placed on a carbon tray. An iron bar made as in Example 1 was placed on top of the paste. After processing as before, the slug emerged from the furnace with a very slight amount of light, easily removed powder. The mechanical properties were as good as in Example 1.

EXAMPLE 3

An iron-carbon-zinc stearate powder blend was pressed into a desired shape. However, the geometry of the part did not allow a conventional solid infiltrating slug to be placed on it. Therefore, infiltrating paste of this invention was placed on the side of the part where it clung tenaciously. The paste remained in place during heat-up in the furnace and did an excellent job of infiltrating providing excellent mechanical properties to the infiltrated part comparable to Example 1.

EXAMPLE 4

A series of infiltrated iron compacts were performed in a manner similar to Example 1 and the results are given in Table 1. The indicated infiltrant weight consists of 95 parts powder metal and 5 parts vehicle (kerosene-rubber). A one-step infiltration and sintering cycle of 15 minutes at 2,050° F in 35° F endogas was used. The iron compacts were 99 parts iron, 1 part zinc, and 1 part graphite.

TABLE 1

| Matrix Density (g/cc) | Infiltrant Weight (%) | Infiltrated Density (g/cc) | Transverse Rupture Strength (ksi) | Size Change (%) |
|---|---|---|---|---|
| 5.8 | 25 | 6.76 | 151 | 0.16 |
| | 35 | 7.30 | 169 | 0.46 |
| | 40 | 7.45 | 184 | 0.56 |
| 6.0 | 20 | 6.74 | 153 | 0.32 |
| | 30 | 7.25 | 170 | 0.52 |
| | 35 | 7.52 | 187 | 0.58 |
| 6.2 | 15 | 6.67 | 141 | 0.40 |
| | 20 | 6.95 | 176 | 0.47 |
| | 25 | 7.26 | 187 | 0.51 |

The foregoing examples are illustrative of this invention and not intended to be limited except by the appended claims.

What is claimed is:

1. A high density infiltrating paste for infiltrating and increasing the strength of a porous iron powder compact, the high density infiltrating paste comprising:

a powder metal blend of copper powder and iron powder dispersed in a volatile hydrocarbon vehicle providing an infiltrating paste containing at least about 95% by weight of said powder metal blend;

said powder metal blend being a uniform powder blend consisting of 98.2 to 96.6 weight parts of copper powder particles intimately interspersed with 1.8 to 3.4 weight parts of powder iron;

said copper powder being substantially spherical copper particles having an average particle size less than about 44 microns;

said iron powder particles being carbonyl iron and having an average particle size less than about 5 microns.

* * * * *